US006443226B1

(12) United States Patent
Diener et al.

(10) Patent No.: US 6,443,226 B1
(45) Date of Patent: Sep. 3, 2002

(54) APPARATUS FOR PROTECTING SENSORS WITHIN A WELL ENVIRONMENT

(75) Inventors: James M. Diener, Niantic; Richard T. Jones, Hamden, both of CT (US)

(73) Assignee: Weatherford/Lamb, Inc., Houston, TX (US)

( * ) Notice: Subject to any disclaimer, the term of this patent is extended or adjusted under 35 U.S.C. 154(b) by 22 days.

(21) Appl. No.: 09/740,757

(22) Filed: Nov. 29, 2000

(51) Int. Cl.[7] ..... E21B 17/10

(52) U.S. Cl. ..... 166/241.6; 166/250.11; 367/188

(58) Field of Search ..... 166/241.2, 241.6, 166/241.7, 250.11, 123, 124; 73/152.17, 152.36; 340/853.9, 856.2; 367/149, 188

(56) References Cited

U.S. PATENT DOCUMENTS

| | | | | |
|---|---|---|---|---|
| 3,149,492 A | | 9/1964 | Weinberg | 73/393 |
| 4,080,837 A | | 3/1978 | Alexander et al. | 73/61 R |
| 4,445,389 A | | 5/1984 | Potzick et al. | 73/861.27 |
| 4,515,473 A | | 5/1985 | Mermelstein | 356/33 |
| 4,520,320 A | | 5/1985 | Potzick et al. | 328/133 |
| 4,603,737 A | * | 8/1986 | Spikes | 166/241.7 |
| 4,706,501 A | | 11/1987 | Atkinson et al. | 73/730 |
| 4,976,151 A | | 12/1990 | Morishita | 73/730 |
| 5,024,099 A | | 6/1991 | Lee | 73/730 |
| 5,031,460 A | | 7/1991 | Kaneobu et al. | 73/730 |
| 5,040,415 A | | 8/1991 | Barkhoudarian | 73/198 |
| 5,083,452 A | | 1/1992 | Hope | 73/61 R |
| 5,218,197 A | | 6/1993 | Carroll | 250/227.19 |
| 5,363,342 A | | 11/1994 | Layton et al. | 367/149 |
| 5,398,542 A | | 3/1995 | Vasbinder | 73/40.5 |
| 5,440,932 A | | 8/1995 | Wareham | 73/730 |
| 5,591,922 A | | 1/1997 | Segeral et al. | 73/861.04 |
| 5,670,720 A | | 9/1997 | Clark et al. | 73/730 |
| 5,737,278 A | * | 4/1998 | Frederick et al. | 367/149 |
| 5,741,980 A | | 4/1998 | Hill et al. | 73/861.04 |
| 5,845,033 A | | 12/1998 | Berthold et al. | 385/12 |
| 6,050,131 A | * | 4/2000 | Willauer | 73/37 |
| 6,151,277 A | * | 11/2000 | Erath et al. | 367/173 |

OTHER PUBLICATIONS

"Noise and Vibration Control Engineering Principles and Applications", Leo L. Beranek and Istvan L. Ver, A Wiley Interscience Publication, pp. 537–541 (Undated).

"Mandrel–Wound Fiber Optic Pressure Sensor", P. Ogle, D. Gysling and A. Kersey, Docket CC–0033, pp. 1–22 (Undated).

CiDRA Presentation on "Flow Meter", Dec. 7–18, 1998, Houston, TX.

"Sound and Sources of Sound", by A. P. Dowling and J. E. Williams, pp. 224–229 (Undated).

* cited by examiner

*Primary Examiner*—David Bagnell
*Assistant Examiner*—Zakiya Walker
(74) *Attorney, Agent, or Firm*—Howrey Simon Arnold & White, LLP

(57) ABSTRACT

An apparatus for protecting sensing devices disposed on an outer surface of a pipe is provided. The apparatus includes a housing and a plurality of bumpers. The housing is attached to the outer surface of the pipe. The bumpers are attached to one of the outer surface of the pipe or the housing. Each bumper includes a post and a bumper pad. The bumpers are enclosed within the region formed between the housing and the pipe.

30 Claims, 3 Drawing Sheets

APPARATUS FOR PROTECTING SENSORS WITHIN A WELL ENVIRONMENT

BACKGROUND OF THE INVENTION

1. Technical Field This invention relates in general to sensing devices used in a petroleum well, and more particularly to devices used to protect the sensing devices within the well environment.

2. Background Information

In the petroleum industry, there is considerable value in the ability to monitor the flow of petroleum products in the production pipe of a well in real time. Acquiring reliable, accurate fluid flow data downhole at a particular source environment is, however, a technical challenge for several reasons. For example, fluid flow within a production pipe is hostile to sensors in direct contact with the fluid flow. Fluids within the production pipe can erode, corrode, wear, and otherwise compromise sensors disposed in direct contact with the fluid flow. There is, accordingly, great advantage in utilizing a sensor disposed outside the pipe. The environment outside the production pipe, however, can also be hostile. Sensors disposed outside a production pipe can easily be damaged during transporting and installation. In addition, the well environment in which production pipes are deployed is typically harsh, characterized by extreme temperatures, pressures, vibrations, and debris. Extreme temperatures can disable and limit the life of sensors, particularly those in contact with the fluid. Unprotected sensors disposed outside of the production pipe may also be subject to environmental materials such as water (fresh or salt), mud, sand, corrosive materials, etc.

What is needed, therefore, is an apparatus that is compact and durable enough to allow the disposition of sensing devices outside the production pipe so that fluid flow within the pipe can be measured in a non-intrusive manner, and one that is capable of protecting the sensing devices during installation and use.

DISCLOSURE OF THE INVENTION

It is, therefore, an object of the present invention to provide an apparatus for protecting sensing devices disposed on the outer surface of a pipe that is capable of protecting such devices during installation and use.

According to the present invention, an apparatus for protecting sensing devices disposed on an outer surface of a pipe is provided. The apparatus includes a housing and a plurality of bumpers. The housing is attached to the outer surface of the pipe. The bumpers are attached to one of, or both, the outer surface of the pipe or the housing. Each bumper includes a post and a bumper pad. The bumpers are enclosed within the region formed between the housing and the pipe.

An advantage of the present invention apparatus is it enables the collection of flow data downhole within a well in a non-intrusive manner, at or near the source of the fluid flow. The apparatus protects the sensing devices by insulating them from elevated temperatures and pressures, and pressure variations present in the annulus. The apparatus also protects the sensing devices from any fluid or debris that may enter the annulus between the production pipe and the well casing. As a result, the present invention can use a wider variety of sensing devices than would otherwise be possible. In addition, in the embodiment where the apparatus is a pressure vessel, the sensing devices are subjected to a substantially constant pressure. Fluctuations in the pressure outside of the pressure vessel that might influence the sensing devices are effectively eliminated. For all of these reasons, the reliability and durability of the sensing devices are accordingly improved.

Another advantage of the present invention is its compact design. The present provides a protective apparatus for sensing devices disposed outside the production pipe, in a compact design that does not interfere with the deployment of the production pipe within the well casing.

The foregoing and other objects, features and advantages of the present invention will become more apparent in light of the following detailed description of exemplary embodiments thereof.

DETAILED DESCRIPTION OF THE INVENTION

Figure 1:
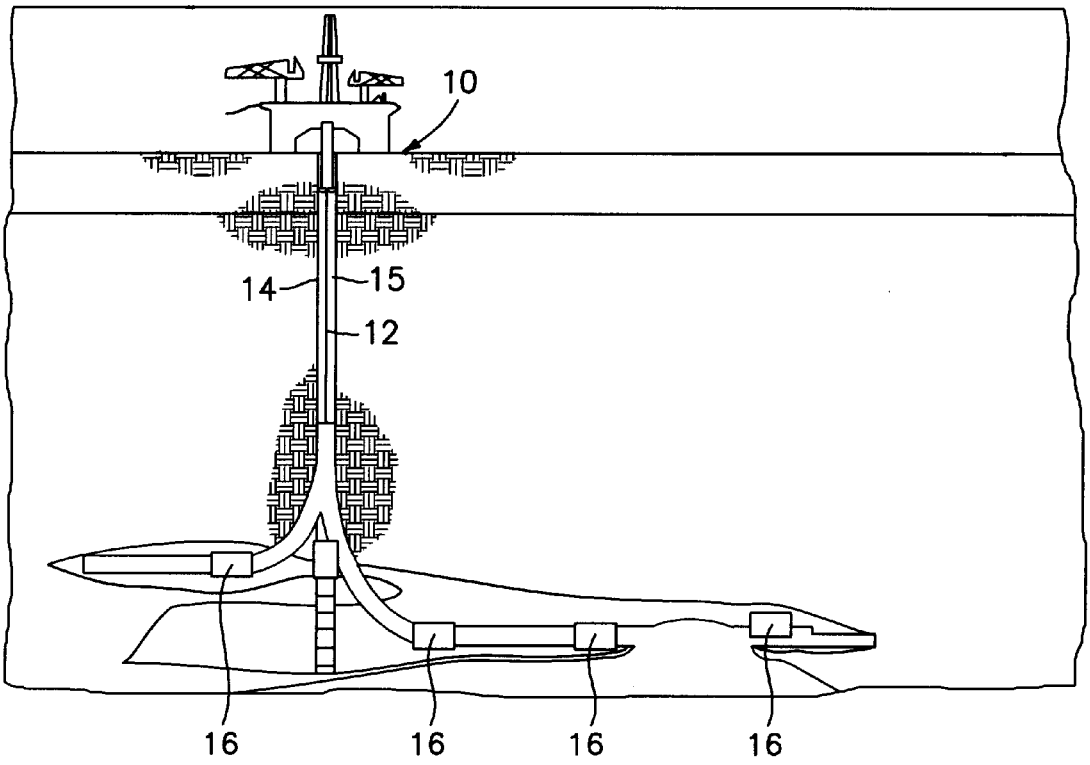
FIG. 1 is a diagrammatic view of a well having a casing and a pipe, and present invention apparatus for protecting sensing devices positioned at various locations along the pipe inside the casing.
Figure 5:
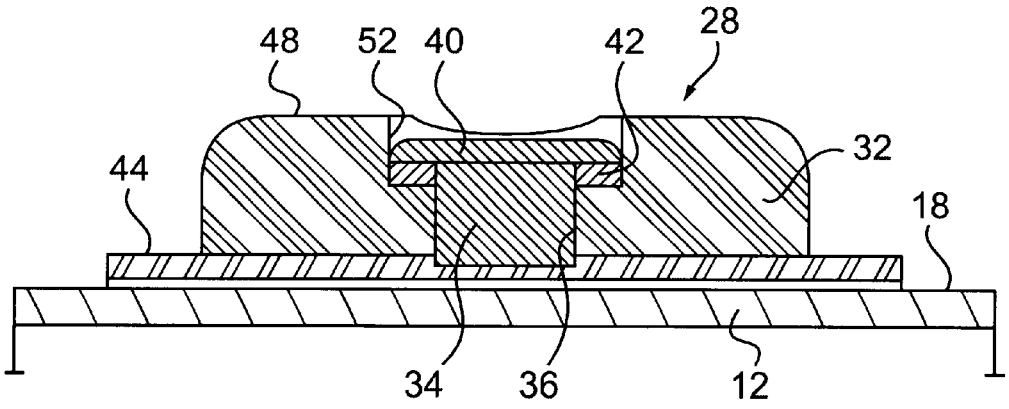
FIG. 5 is a diagrammatic sectional view of the bumper shown in FIG. 4.
Figure 2:
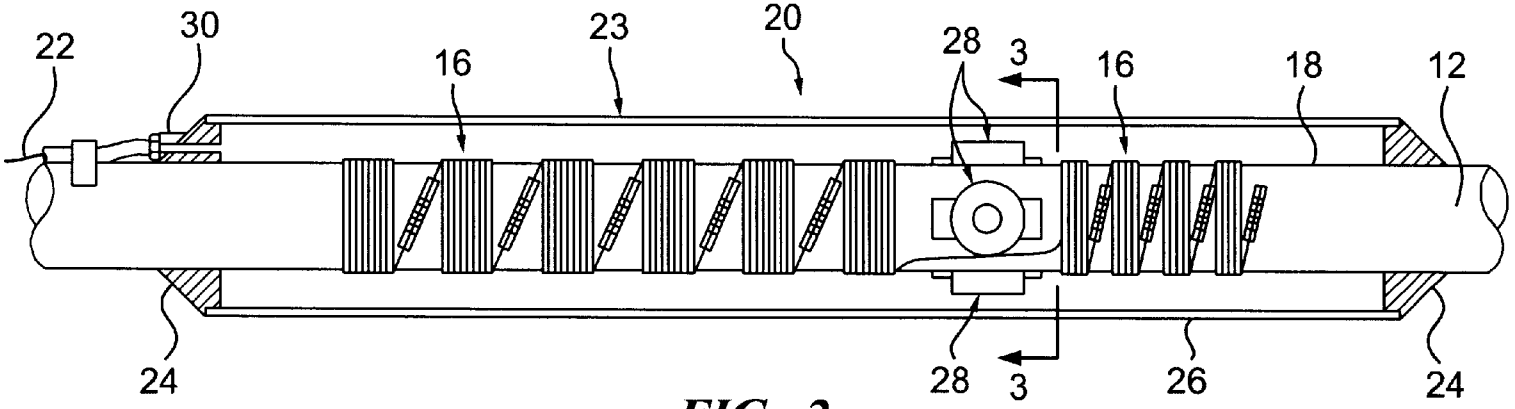
FIG. 2 is a diagrammatic view of an exemplary embodiment of the present invention apparatus for protecting sensing devices mounted on a pipe.

Referring to FIGS. 1 and 2, there is shown an intelligent oil well system 10 containing one or more production pipes 12 that extend downward through a casing 14 to one or more petroleum sources. The cross-sectional area of the production pipe 12 is smaller than that of the casing 14, thereby forming an interior region 15 between the two. Each production pipe 12 may include one or more sections that branch off to access different petroleum sources or different areas of the same petroleum source. Fluid mixtures are pumped from the sources to the platform through the production pipes 12. The production pipe(s) 12 includes one or more sensing devices 16 attached to an outer surface 18 (see FIG. 2) of a section of the production pipe 12. Each sensing device 16 is enclosed within a present invention apparatus 20 for protecting the sensing devices. The sensing devices 16 receive and transmit signals via communication cables 22 that extend between the sensing devices 16 and the instrumentation residing on the well platform or at a remote location in communication with the platform.

Referring to FIG. 2, the apparatus 20 for protecting a sensing device disposed on the outer surface 18 of a pipe 12 includes a housing 23, and a plurality of bumpers 28. The housing 23 includes a pair of cap ends 24 and a sleeve 26 extending between and attached to the cap ends 24. The bumpers 28 are attached to one of the pipe outer surface 18 or the sleeve 26. The cap ends 24 and the sleeve 26 extend around the circumference of the pipe 12. The cap ends 24 extend outward from the pipe outer surface 18, and thereby create an annular region between the pipe outer surface 18 and the sleeve 26 within which the sensor(s) 16 resides. The communication cable(s) 22 that extends between the sensing device 16 and the instrumentation passes through a sealable port 30 in one or both cap ends 24 and connects with the sensing devices 16.

Referring to FIGS. 3–6, each bumper 28 includes a bumper pad 32 and a post 34 to locate the bumper pad 32. The post 34 is received within an aperture 36 (see FIGS. 5 and 6) located in the mid-portion of the bumper pad 32. The bumper pad 32 consists of a temperature tolerant material appropriate for the application at hand. In our experience, the material known as "PEEK" (polyetheretherketon) is a favorable bumper pad material for petroleum well applications because of its high temperature capability and its low coefficient of friction. The post 34 is attached directly or indirectly to either the pipe outer surface 18 or the sleeve 26. In those instances where the post 34 is directly attached to the pipe outer surface 18 (see FIG. 3), the surface 37 of the post 34 in contact with the pipe outer surface 18 is contoured to match the contour of the pipe outer surface 18. A retainer 38 (e.g., a washer and a retaining clip) can be used with the post 34 to ensure the post 34 and bumper pad 32 remain coupled. The number of bumpers 28 can vary to suit the application. In our experience, it is preferable to have at least three (3) or four (4) bumpers 28 disposed around the circumference of the pipe 12. Three or four bumpers 28 will typically accommodate relative movement between the sleeve 26 and the pipe 12 and keep the pipe 12 substantially centered within the sleeve 26. Room between adjacent bumpers 28 permits sensing device cables 22 to pass through unobstructed.

In an exemplary embodiment, each bumper 28 includes a retaining flange 40 and a biasing device 42 mounted on the post 34, and a mounting strap 44. Acceptable biasing devices 42 include, but are not limited to, wave washers, helical springs, Belleville washers, etc. The retaining flange 40 is attached to one end of the post 34. The biasing device 42 is mounted on the post 34 between the retaining flange 40 and the bumper pad 32. The end of the post 34 opposite the flange 40 is attached to the strap 44. It is preferable to have each strap 44 extend out a distance beyond the periphery of the bumper pad 32 to facilitate attachment to the pipe 12. The strap 44 shown in FIGS. 3–6 is oriented in an axial direction, but may alternatively be oriented circumferentially. The strap 44 is preferably shaped to conform to the profile of the pipe 12 to which it is attached. The bumper pad 32 has a pipe-side surface 46 and a sleeve-side surface 48. The pipeside surface 46 faces the strap 44 and preferably includes a slot 50 (FIG. 6) for receiving the strap 44. Once the strap 44 is received within the slot 50, the bumper pad 32 is restrained from rotating around the post 34. The sleeve-side surface 48 faces the biasing device 42 and the flange 40, and preferably includes a cavity 52 shaped to receive the biasing device 42 and the flange 40. Receiving the flange 40 and biasing device 42 within the cavity 52 helps prevent contact between the post 34 and the sleeve 26. The biasing device 42 biases the bumper pad 32 toward the pipe outer surface 18. The pipe-side surface 46 of the bumper pad 32 has a contoured profile that matches the geometry of the pipe 12.

Figure 6:
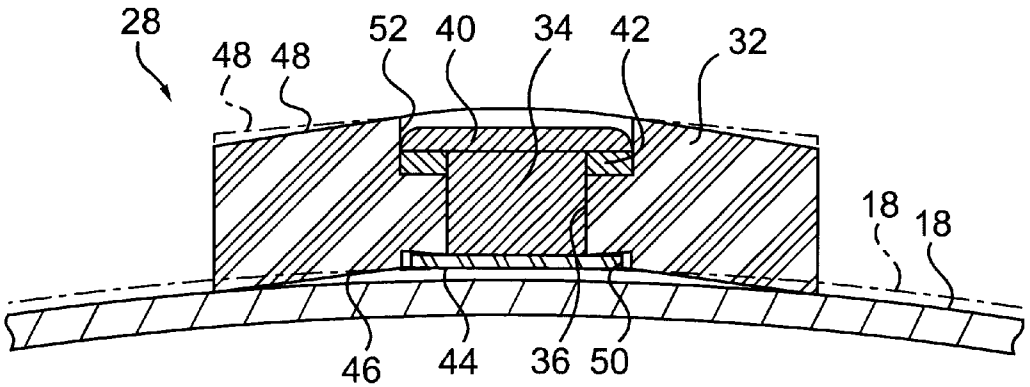
FIG. 6 is a diagrammatic sectional view of the bumper shown in FIG. 4.
Figure 3:
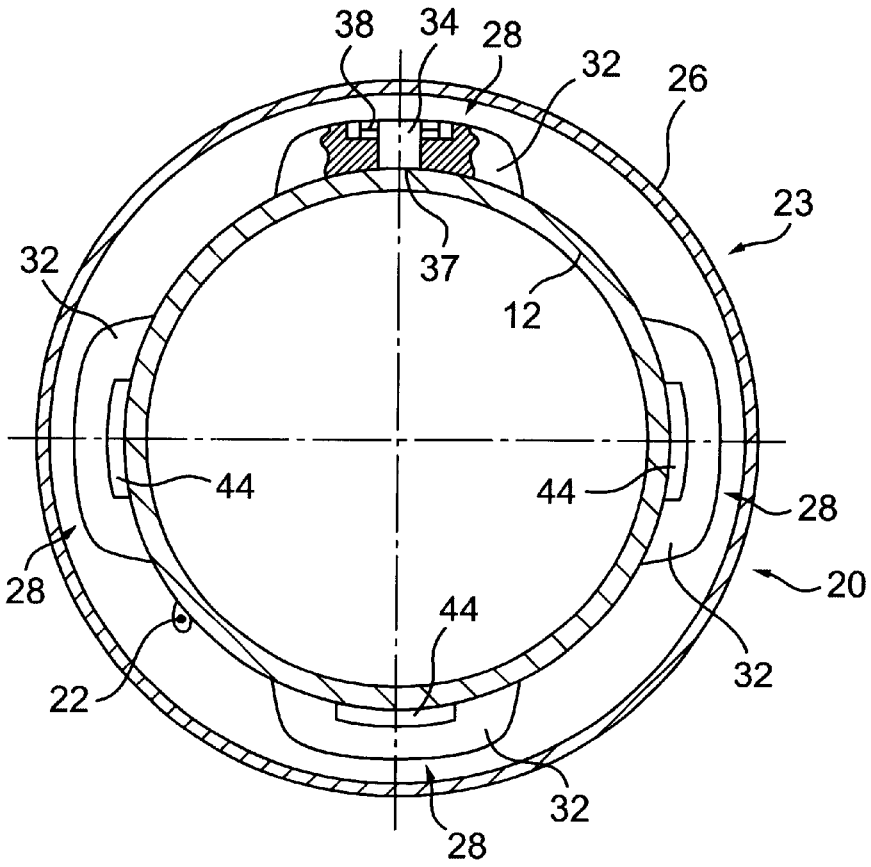
FIG. 3 is a diagrammatic sectional view of the present invention apparatus for protecting sensing devices.
Figure 4:
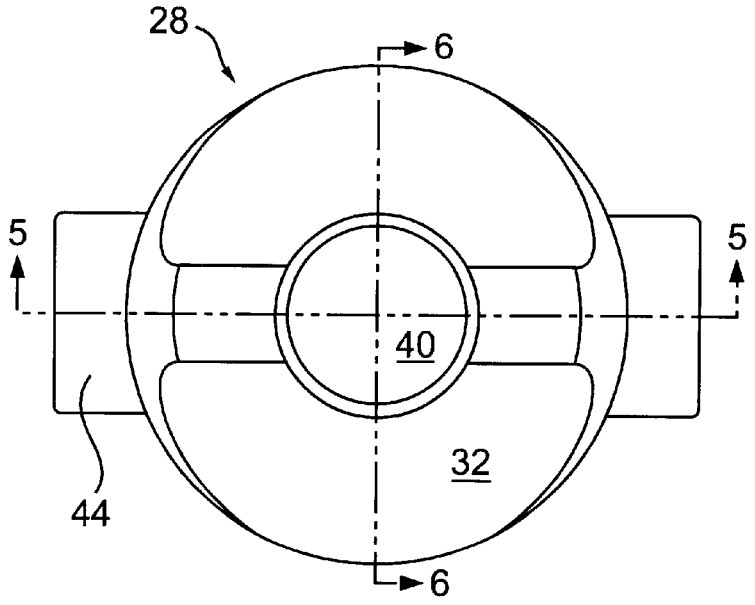
FIG. 4 is a diagrammatic top view of a present invention bumper.

In the embodiment shown in FIG. 6, the contoured profile of the bumper pad 32 has a slight interference fit between the bumper pad 32 and the pipe outer surface 18 when the strap 44 is attached to the pipe 12. The slight interference fit can be accomplished, for example, by using a pipe-side surface 46 contour where the outer edge of the bumper pad 32 extends below the strap 44 prior to the strap 44 being attached to the pipe outer surface 18. Once the strap 44 is attached to the pipe 18, the bumper pad 32 is biased against the outer surface 18 of the pipe 12. A strap 44 that extends out beyond the periphery of the bumper pad 32, as described above, helps to create the bias between the bumper pad 32 and the pipe 12. FIG. 6 shows the bumper 28 prior to attachment to the outer surface 18 of the pipe 12 in solid line and after attachment in phantom line to illustrate deflection of the bumper pad 32 and the bias of the bumper pad 32 against the pipe 18. The embodiment shown in FIG. 6 can be used in place of or in addition to the above-described biasing device 42.

Biasing the bumper pad 32 against the pipe 12 helps keep the bumper pad 32 stationary. Biasing the bumper pad 32 against the pipe 12 also improves the manufacturability of the bumpers 28 because it permits the various components of each bumper 28 to be made with greater dimensional tolerances. In addition, the amount of radial travel permitted by the biasing device 42 and/or the magnitude of the interference fit between the bumper pad 32 and the pipe 12 is chosen to accommodate the amount of thermal expansion expected for the bumper 28 and the pipe 12 in the application at hand. The present invention bumpers 28 can also function to keep an interior pipe (e.g., the production pipe) substantially centered within the outer pipe (e.g., the sleeve).

Referring to FIG. 2, in all embodiments the size and structure of the apparatus 20 for protecting the sensing devices are chosen to withstand the pressure gradients present in the well environment and to accommodate the size of the sensing devices for the application at hand. The bumpers 28 provide the function of ensuring that the sleeve 26 does not deflect an amount that will interfere with the sensors 16 located between the sleeve 26 and the outer surface 18 of the pipe 12.

In a preferred embodiment, the housing 23 and the pipe 12 collectively form a pressure vessel. In other embodiments, the housing 23 is sealed on the pipe 12 to protect the sensing devices 16, but does not act as a pressure vessel. In a preferred embodiment, the housing 23 is filled with a gas such as air, nitrogen, or argon. The advantages of a gaseous environment within the housing 23 include the gas acting as a thermal insulator, and as an acoustic isolator that helps reduce pressure wave interference that might otherwise travel into the housing 23 from the region between the pipe 12 and the casing 14 and undesirably influence the sensing devices 16.

Although the invention has been described and illustrated with respect to exemplary embodiments thereof, the foregoing and various other additions and omissions may be made therein and thereto without departing from the spirit and scope of the present invention. For example, the present apparatus 20 has been described in the Detailed Description section as being mounted on a cylindrical pipe 12. The present apparatus is not limited to cylindrical conduits, and can be used with conduits having alternative cross-sectional geometries.

What is claimed is:

1. An apparatus for protecting sensing devices attached to an outer surface of a pipe, said apparatus comprising:

a pair of cap ends attached to said pipe;

a sleeve attached to and extending between said cap ends, wherein said cap ends extend out from said pipe;

wherein said cap ends and said sleeve extend around a circumference of said pipe to form an annular region between said cap ends, said sleeve, and said outer surface of said pipe; and a plurality of bumpers disposed in said annular region and attached to one of said outer surface of said pipe or said sleeve, but not attached to both said outer surface of said pipe and said sleeve, wherein each said bumper includes a post and a bumper pad.

2. The apparatus of claim 1, wherein in each said bumper, said post is received within an aperture disposed in said bumper pad.

3. The apparatus of claim 2, wherein each said bumper further comprises a retainer attached to said post, wherein said retainer retains said bumper pad.

4. The apparatus of claim 3, wherein said bumpers are attached to said outer surface of said pipe, and each said bumper further comprises a biasing means that biases said bumper pad against said outer surface of said pipe.

5. The apparatus of claim 4, wherein said biasing means comprises an interference fit between said bumper pad and said outer surface of said pipe.

6. The apparatus of claim 3, wherein each said bumper further comprises a biasing device mounted on said post.

7. The apparatus of claim 6, wherein said bumper pad includes means to prevent rotation of said bumper relative to said pipe.

8. The apparatus of claim 7, wherein said cap ends and said sleeve form a pressure vessel with said outer surface of said pipe.

9. The apparatus of claim 2, wherein each said bumper further comprises a mounting strap, and within each said bumper, said post is attached to said mounting strap and said mounting strap is attached to said outer surface of said pipe.

10. The apparatus of claim 9, wherein each said bumper pad comprises a slot to receive said mounting strap, and said strap prevents said bumper pad from rotating relative to said strap.

11. The apparatus of claim 10, wherein each said bumper further comprises a biasing means that biases said bumper pad against said outer surface of said pipe.

12. The apparatus of claim 10, wherein each said bumper further comprises a biasing device mounted on said post.

13. The apparatus of claim 2, wherein each said bumper compensates for thermal growth.

14. The apparatus of claim 2, wherein each said bumper includes means for compensating for thermal growth.

15. The apparatus of claim 1, wherein each said bumper further comprises a biasing means that biases said bumper pad against said outer surface of said pipe.

16. The apparatus of claim 1, wherein each said bumper further comprises a biasing device mounted on said post.

17. An apparatus for protecting sensing devices attached to an outer surface of a conduit, said apparatus comprising:

a pair of cap ends attached to said conduit;

a sleeve attached to and extending between said cap ends, wherein said cap ends extend out from said conduit;

wherein said cap ends and said sleeve extend around a periphery of said conduit to form an annular region between said cap ends, said sleeve, and said outer surface of said conduit; and a plurality of bumpers disposed in said annular region and attached to one of said outer surface of said conduit or said sleeve, but not attached to both said outer surface of said pipe and said sleeve, wherein each said bumper includes a post and a bumper pad.

18. An apparatus for protecting sensing devices attached to an outer surface of a pipe, comprising:

a housing coupled to the outer surface of the pipe to form an annular region around the sensing devices; and a plurality of bumpers disposed in the annular region and coupled to one of the outer surface of the pipe or an inner surface of the housing, but not coupled to both the outer surface of the pipe and the inner surface of the housing.

19. The apparatus of claim 18, wherein the housing comprises two end caps coupled to the outer surface of the pipe and a sleeve coupled to and extending between the end caps.

20. The apparatus of claim 18, wherein the bumpers are coupled to one of the outer surface of the pipe or an inner surface of the sleeve by posts coupled to either the outer surface of the pipe or the inner surface of the sleeve.

21. The apparatus of claim 20, wherein the posts are received within apertures in the bumpers.

22. The apparatus of claim 21, wherein the bumpers further comprises retainers attached to the posts for retaining the bumpers.

23. The apparatus of claim 21, wherein the bumpers further comprises means for biasing the bumpers against the outer surface of the pipe or the inner surface of the sleeve.

24. The apparatus of claim 18, wherein the bumpers further comprise straps, wherein the posts are coupled to straps, and wherein the straps are coupled to one of the outer surface of the pipe or the inner surface of the housing.

25. The apparatus of claim 24, wherein the each of the bumpers includes a slot to receive the straps.

26. The apparatus of claim 24, wherein the bumper deform when coupled to one of the outer surface of the pipe or the inner surface of the housing.

27. The apparatus of claim 18, wherein the annular region is sealed.

28. The apparatus of claim 27, wherein the annular region is filled with a gas selected from the group consisting of air, nitrogen, and argon.

29. The apparatus of claim 18, wherein the bumpers comprise a polymer.

30. The apparatus of claim 18, wherein the polymer is polyetheretherketon.

* * * * *